US007273198B2

(12) United States Patent
Tourtellotte et al.

(10) Patent No.: US 7,273,198 B2
(45) Date of Patent: Sep. 25, 2007

(54) SUPPORT STAND ASSEMBLY AND METHOD

(76) Inventors: Mills C. Tourtellotte, 1114 Inwood Dr., Richmond, TX (US) 77469; Frank Alderete, 208 Eighth St., Rosenberg, TX (US) 77471

( * ) Notice: Subject to any disclaimer, the term of this patent is extended or adjusted under 35 U.S.C. 154(b) by 93 days.

(21) Appl. No.: 10/983,492

(22) Filed: Nov. 8, 2004

(65) Prior Publication Data

US 2005/0167552 A1 Aug. 4, 2005

(51) Int. Cl.
*F16M 11/38* (2006.01)

(52) U.S. Cl. ..... 248/166; 248/170

(58) Field of Classification Search ..... 248/158, 248/166, 167, 168, 170, 188.2, 188.8, 519, 248/528, 529; 40/607.1, 607.04, 607.01
See application file for complete search history.

(56) References Cited

U.S. PATENT DOCUMENTS

| | | | | |
|---|---|---|---|---|
| 2,482,979 | A * | 9/1949 | Isakson | 248/188.7 |
| 3,685,162 | A * | 8/1972 | Haun | 33/295 |
| 4,288,052 | A * | 9/1981 | Scott | 248/188.6 |
| 4,888,894 | A | 12/1989 | Brown, Jr. | |
| 5,318,258 | A | 6/1994 | Lang | |
| 5,441,267 | A | 8/1995 | Alder | |
| 5,829,178 | A | 11/1998 | Hillstrom | |
| 5,871,185 | A * | 2/1999 | Phillips et al. | |
| 5,876,011 | A * | 3/1999 | Blasing | 248/411 |
| 5,961,248 | A | 10/1999 | Tourtellotte | |
| 5,964,524 | A * | 10/1999 | Qian | 362/414 |
| 6,007,032 | A * | 12/1999 | Kuo | 248/185.1 |
| 6,336,623 | B1 | 1/2002 | McCarthy | |
| 6,585,199 | B1 * | 7/2003 | Yu | 248/166 |
| 6,688,565 | B1 * | 2/2004 | Chen | 248/166 |
| 6,783,259 | B1 * | 8/2004 | Macedonio | 362/251 |
| 7,021,592 | B2 * | 4/2006 | Brandes | 248/181.2 |
| 2004/0155159 | A1 * | 8/2004 | Tiffen et al. | 248/177.1 |

OTHER PUBLICATIONS

Advertisements found at www.globalindustrial.com entitled "Portable Safety Barricade" (p. 221); "Portable Barricade" (p. 219); "Indoor/Outdoor Pedestrian Control"; "Protective Rail Barrier" (p. 219); "Premium Control Barrier" (p. 222); "High Visibility Barrier" (p. 222); "Outdoor Hi-Visibility Barrier" (p. 222); "Pedestrian Barrier" (p. 220); and "Barrier Warning Tape" (p. 220).
Advertisements found at www.grainger.com entitled "Delineator Post" (p. 2788); "Plastic Safety Fence" (p. 2788); and "Warning Barrier Fence".
Advertisements shown in McMaster-Carr publication entitled "Traffic and Control Barriers and Tape" (p. 1725).

* cited by examiner

*Primary Examiner*—A. Joseph Wujciak
(74) *Attorney, Agent, or Firm*—Kenneth L. Nash

(57) ABSTRACT

One or more support stand assemblies are utilized for mounting functional equipment or creating a barrier on variable surfaces or a surface which may be sloped. Each support stand preferably includes a support post configured to be releaseably secured to a stabilizer member with the support post including a functional end adapted for attachment to a functional structure. The support stand further includes a base preferably including first and second legs being configurable in a set up operating configuration and alternately a collapsed stowed configuration. After use, the support post is removed from the stabilizer member and the locking faster is loosened to permit the first and second legs to be substantially aligned and stowed adjacent the support post in a compactable bundle for handling and shipping.

1 Claim, 10 Drawing Sheets

SUPPORT STAND ASSEMBLY AND METHOD

FIELD OF THE INVENTION

The present invention relates generally to barriers and signs and, more particularly, to a portable safety barrier.

BACKGROUND OF THE INVENTION

Safety barriers are utilized for many purposes. For instance, in the construction industry, a safety barrier or display sign with a support stand is commonly used to cordon off a restricted area or warn of potentially dangerous conditions. Support stands used with such devices may be collapsible. A collapsible stand may be used, for example, to support a barrier structure, ribbons or flags around a construction site, to support a safety sign used around roadside or highway construction areas, or for other purposes where portability is needed to move the barrier or sign or to pack it up and relocate it to another construction site or the like. Of course, portable barriers or signs with collapsible support structures may be used for many other purposes as well, such as, for example, to visibly mark off queued areas inside a movie theatre, display store advertisements indoors or outdoors, etc.

Collapsible prior art barriers often require complicated spring-loaded foldable and/or multiple articulating mechanisms to achieve portability. Many such complex devices require certain specially designed support stand parts which do not foster overall interchangeability and simplicity. Replacing damaged components of such structures can in some cases require substantial time due to the numerous interlocking and/or bolted assemblies that must be disassembled and reassembled to repair the device. It also may be difficult—and over time, impossible—to readily find replacement parts for specially designed component parts of such structures—thus effectively rendering the entire device un-useable.

Stability is another essential feature of a support stand structure used with a barrier or a sign. Stability is especially critical when positioning a safety barrier or sign indoors or in an outdoor environment (e.g., in windy or rainy conditions, etc.)—near road traffic or pedestrians passing by. A support stand needs stabilizing structures to help minimize the possibility of the mounted barrier or sign being blown over into oncoming traffic or knocked over and injuring passing pedestrians. Stand leveler structures are generally needed to help keep the barrier or sign oriented properly when used to block-off, barricade, or warn drivers or pedestrians of dangerous areas around highway or building construction sites.

Moreover, generally, typical collapsible support stands are a functional component of a safety barrier or a sign—rather than being integrally compactable in combination with both a safety barrier and also a display sign. That is, various portable devices are constructed as either a combination of a safety barrier and collapsible support stand or—alternatively—a combination of a display sign and collapsible support stand—but not the combination of all three of these structures.

Prior art collapsible stand devices lack structures adapted to enhance stability when used on certain sloped or irregularly contoured ground or road surfaces and the barrier/sign and support stand structural configuration that fosters compactibility. Moreover, prior art structures use specialized parts that create repair and replacement problems.

Prior art patents which disclose attempts to solve the above problems are set forth as follows:

U.S. Pat. No. 5,318,258 to Lang, entitled "Portable Highway Sign Stand," is directed to a portable collapsible highway sign stand for standard rollup and rigid warning, regulatory and informational signs. This device has an elongated vertical rigid sign-supporting mast which is supported by a multi-legged base. The legs are pivotally supported for movement from a first folded position parallel to the mast to a second position in which the legs are splayed outwardly and secured in place by a single central retainer pin. A sign mounting jaw including a first fixed outer jaw and a slidable inner jaw member is secured to the top of the mast. A mast tilt adjuster is incorporated to adapt use of the sign stand to non-level terrain.

U.S. Pat. No. 4,888,894 to Brown, Jr., entitled "Stand for Safety Sign or the Like," sets forth a sign stand for supporting highway safety signs or the like. The stand includes a plurality of folding legs which support the stand on the ground. The legs support a socket having an open upper end to receive the mounting bracket formed at one corner of a side. A latch mechanism includes a hook normally extending within the socket, and cammed to one side as the mounting bracket enters the socket. The lever extends laterally from a side of the socket, enabling withdrawal of the hook to remove the sign.

U.S. Pat. No. 6,336,623 B1 to McCarthy, entitled "Portable Safety Barrier," sets forth an example of device with multiple upright adjacent posts spaced apart which are each pivotably mounted on a first base plate affixed along an edge of a precipice. The posts have bores through opposed sides and L-shaped brackets mounted on at least one side surface. A triangular brace has a second base plate spaced inwardly from the post. Two arms converging inwardly distal from the second base plate connect ends of the second base plate to the post. The arms pivot with respect to the second base plate. Ropes are threaded through the bores or 2×4's are mounted on the L-brackets or mesh is hung on the L-brackets to create a barrier between the spaced apart posts.

U.S. Pat. No. 5,441,267 to Alder, entitled "Portable Golf Target Stand," sets forth an example of a portable golf target stand having a base member, with the base member including pivotally mounted legs, with the legs arranged in a canted orientation relative to a top wall of the base member, such as the legs are arranged for inter-folding configuration to orient the leg members in a substantially parallel relationship when thusly inter-folded, with a signal rod arranged for selective reception within the base member, and the signal rod arranged for a break-down configuration for ease of storage of the signal rod when separated from the base member.

U.S. Pat. No. 5,829,178 to Hillstrom, entitled "Portable Collapsible Sign and Stand," is directed to a collapsible sign member which is attached to a collapsible base member. The two members can be disassembled and folded-up into a compact package for storage and transport. Horizontal cross-brace members for the sign member are connected to a central bracket member which is releasably attached to a vertical upright member in the base member. Another cross-brace member is slidably received in the vertical upright member. A sign panel is connected to the ends of horizontal and vertical cross-brace members and the vertical upright member in order to be fully displayed for viewing by passing motorists and pedestrians. A foldable flag mechanism is used to display a set of warning flags. The flag mechanism is pivotally attached to the vertical cross-brace member. The combination sign and sign stand assembly can be quickly and readily assembled to its display condition and, correspondingly, disassembled and folded-up to its storage and transport condition.

My earlier U.S. Pat. No. 5,961,248 is incorporated herein by reference.

Publications of devices related to barricades are shown at www.globalindustrial.com entitled "Portable Safety Barricade" (page 221); "Portable Barricade" (page 219); Indoor/Outdoor Pedestrian Control;" Protective Rail Barrier" (page 219); "Premium Control Barrier" (page 222); "High Visibility Barrier" (page 222); "Outdoor Hi-Visibility Barrier" (page 222); "Pedestrian Barrier" (page 220); and "Barrier Warning Tape" (page 220). Other publications are shown at www.grainger.com entitled "Delineator Post" (page 2788); "Plastic Safety Fence" (page 2788); Warning Barrier Fence"; and they are also shown in McMaster-Carr publication entitled "Traffic and Control Barriers and Tape" (page 1725).

There remains a need for a uniquely collapsible barrier and sign support stand combination configured for easy setup and breakdown—as well as being compact, in the collapsed position—without the need for numerous specially configured interconnecting, foldable subcomponents and without the need for numerous special components lacking simplicity and ready interchangeability and replaceability—and which is also adapted to help enhance stability on flat as well as irregularly contoured or sloped surfaces.

Those of skill in the art will appreciate the present invention which addresses the above needs and other significant needs the solution to which are discussed hereinafter.

SUMMARY OF THE INVENTION

Accordingly the present invention provides an economical and highly adaptable support stand assembly for creating a barrier with readily replaceable components comprising elements such as a support post having a functional end adapted for attachment to a functional structure such as for a sign, barrier line, or the like, and a base comprising at least a first leg and a second leg pivotally attached with respect to each other. The first leg and the second leg may be orientable at a given angle with respect to each other in an operating configuration for engaging the surface. The legs be alternately orientable to a closed stowed configuration with the first leg and the second leg oriented substantially parallel with respect to each other. A stabilizer member is preferably attachable to at least one of the first leg or the second leg, the stabilizer member being selectively located so as block movement of the first leg with respect to the second leg so as stabilize the base and the support post in the selected operating configuration, the first leg and the second leg forming a plane at least substantially orthogonal to the support post.

In another embodiment, the stabilizer member is attachable in a region around a midpoint of at least one leg, the stabilizer member being located so as to block certain further rotation of the first leg with respect to the second leg when the legs are oriented in a selected operating configuration, the stabilizer member comprising a connector for releaseably securing the support post in a substantially upright orientation.

The support stand assembly of further comprises a plurality of support posts, a plurality of bases, and a plurality of stabilizer members interconnected as discussed above to provide a safety barrier, sign post, or other suitable usage therefore.

In operation, a method is provided for setting up a barrier comprising such as pivotally connecting a first leg and a second leg to form a base, attaching a stabilizer member to the first leg adjacent a midpoint thereof, orienting the second leg in a range of angles which may or may not be substantially around 90 degrees with respect to the first leg. The second leg may or may not positively contact the outer surface of the stabilizer member to foster stability of the base in a set up configuration. Other steps may comprise mounting the support post to the stabilizer member to secure the support post in a substantially upright orientation, and attaching one or more barrier lines to the support post. The method may also comprise attaching a display sign structure to a sign frame comprised of at least one frame member and selectively mounting the sign frame to a sign post.

When the support stand is mounted on a soft surface (ground), the internal section of the leveler feet must be pounded into the soft media (ground) to make the stand more wind resistant than when mounted on a hard surface (concrete). The internal section when mounted on a soft surface must be longer than when mounted on a hard surface. Accordingly, it may be necessary to provide long and short internal sections.

BRIEF DESCRIPTION OF DRAWINGS

For a further understanding of the nature and objects of the present invention, reference should be had to the following detailed description, taken in conjunction with the accompanying drawings, in which like elements may be given the same or analogous reference numbers and wherein.

GENERAL DESCRIPTION AND PREFERRED MODES FOR CARRYING OUT THE INVENTION

Figure 1:
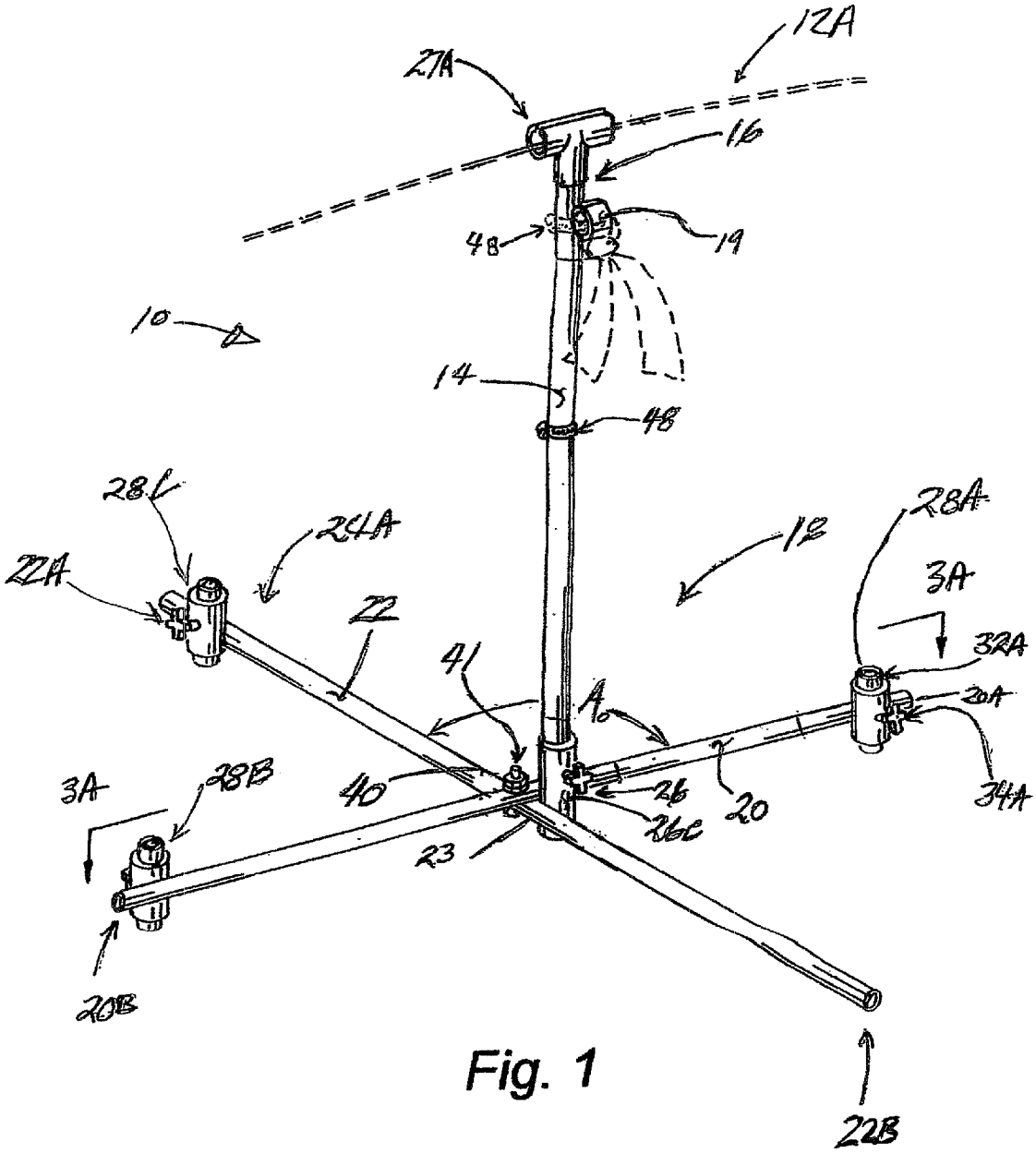
FIG. 1 is a perspective view of one possible embodiment of a support stand assembly shown in a set up, operating configuration for supporting barrier equipment or other functional structures in accord with the invention.
Figure 2:
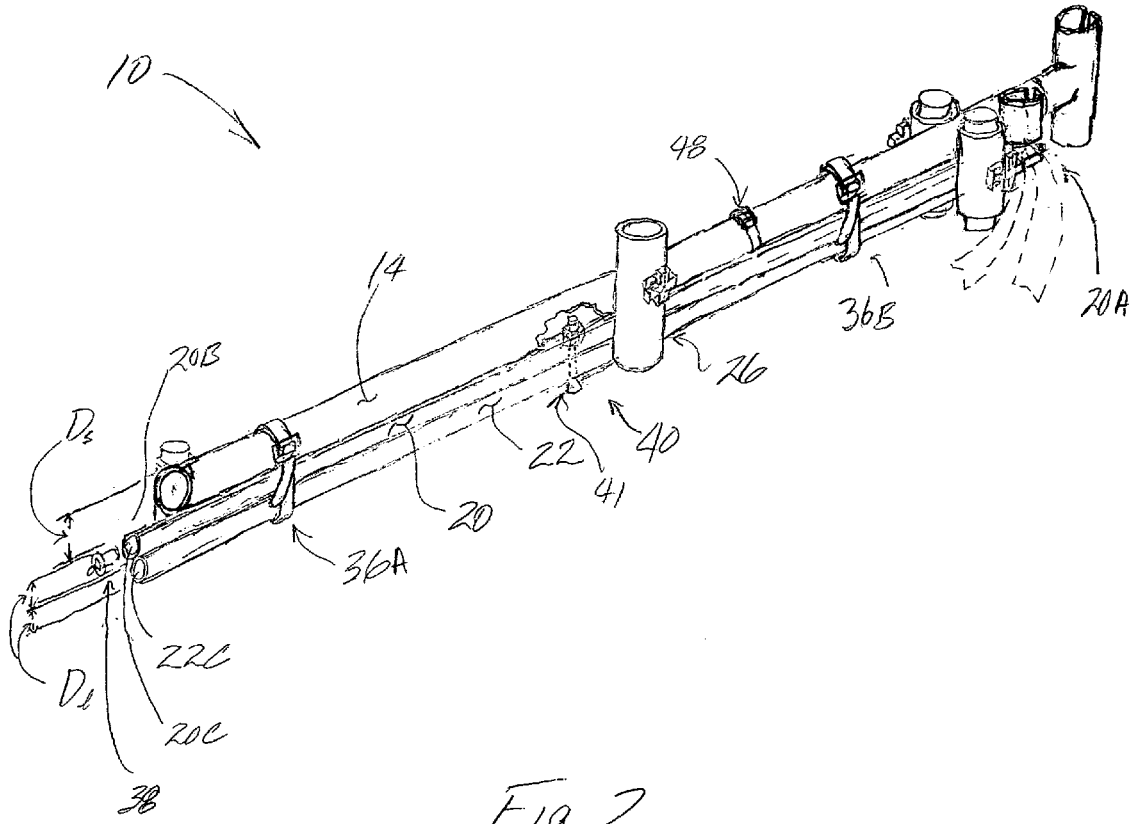
FIG. 2 is a perspective view of one possible embodiment of the invention alternately shown in a collapsed, stowed configuration for storage and shipping.

Referring initially to FIG. 1 and FIG. 2, there is shown a portable support stand assembly 10 for mounting functional structure on variable surfaces or a surface which may be sloped. Such functional structure may include barrier equipment such as, for example, a barrier line 12A as shown in FIG. 1. The support stand 10 is configurable to mount other functional structure 12 as illustrated in FIG. 9, such as for example, signal flags 12B, sign equipment 12C, and numerous other functional structures 12D, 12E (as will be explained hereinafter).

In one presently preferred embodiment, the versatile support stand assembly 10 is adapted to be set up in an operating configuration for use on surfaces such as, for example, a hillside or sloped roof, irregularly contoured ground or road surfaces (e.g., near highway or building construction sites), flat surfaces (e.g., indoors to cordon off queued or restricted areas), and on various other types of terrain (e.g., grassy or rocky ground) or surfaces, including concrete.

Support stand 10 includes various structures adapted to enhance stability when the support stand 10 is used on variable terrain or irregular surfaces which may exist near on a variety of road or ground surfaces and also surfaces such as a steeply pitched roof or the like. Such stability is especially important when the support stand 10 is used to support a safety barrier 12A or other mountable structures 12 such as a sign or various types of equipment when used indoors or in an outdoor environment (for example, in windy or rainy conditions, etc.) or near an area having high pedestrian traffic or road traffic.

Figure 9:
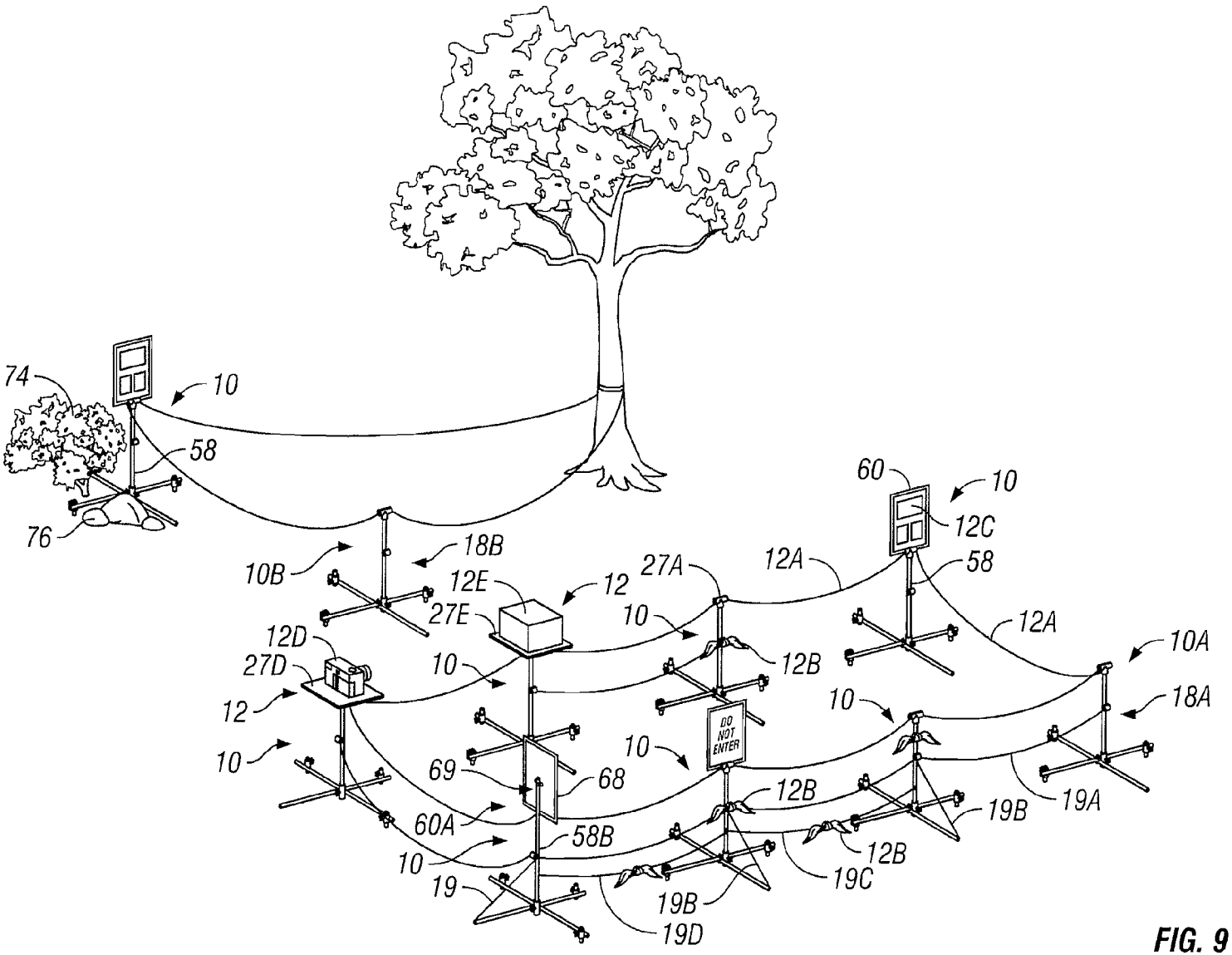
FIG. 9 is a schematic of several possible embodiments of the invention showing the support stand assembly used to mount various functional structures with the support stand base legs in differing orientations, and showing the support stand mounting multiple barrier structures and sign frame structures.

A plurality of support stands 10 may be used in a series, as shown in FIG. 9, to support a desired stretch of barrier line 12A to cordon off an area or to support various functional equipment 12, 12B, 12C, 12D, 12E as well as other mountable equipment.

As shown in FIG. 2, the support stand 10 is portable and also alternately adapted to be collapsed into a tightly compacted bundle to facilitate handling or shipping, for example, from one construction site to another.

Referring again to FIG. 1, one embodiment of support stand 10 is shown in the set up, operating configuration being used to support barrier line 12A. A preferred embodiment of the support stand 10 includes a support post 14 having a functional end 16 adapted for attachment to a functional structure 12. As shown in FIG. 1, functional structure 12 is a barrier line 12A such as a yellow safety ribbon or the like, however functional structure 12 may also include barrier equipment or other structures, devices, or objects which may be used to set up a barricade to cordon off an area, such as safety ropes, signal flags 12B, and signs 12C as shown in FIG. 9. The functional structure may also include video equipment 12D, surveying equipment 12E, or other structures mountable to the functional end 16 of the support post (as will be explained further hereinafter).

In a preferred embodiment, support stand 10 includes a base 18 constructed from at least a plurality of legs and ideally from a first leg 20 and a second leg 22 pivotally attached with respect to each other. The first leg 20 and second leg 22 are rotatable so as to be orientable at a given angle, as denoted by Ao shown in FIG. 1. In one preferred embodiment, first and second legs 20, 22 are connected at a fixed pivot point 23 so as to be rotatable with respect to each other in a scissor-leg configuration.

FIG. 1 illustrates the support stand assembly 10 in an operating or set up configuration. The first leg 20 and second leg 22 are alternately orientable to the closed stowed configuration as shown in FIG. 2 such that the first leg 20 and second leg 22 are oriented substantially parallel with respect to each other (as will be described hereinafter).

Figure 3A:
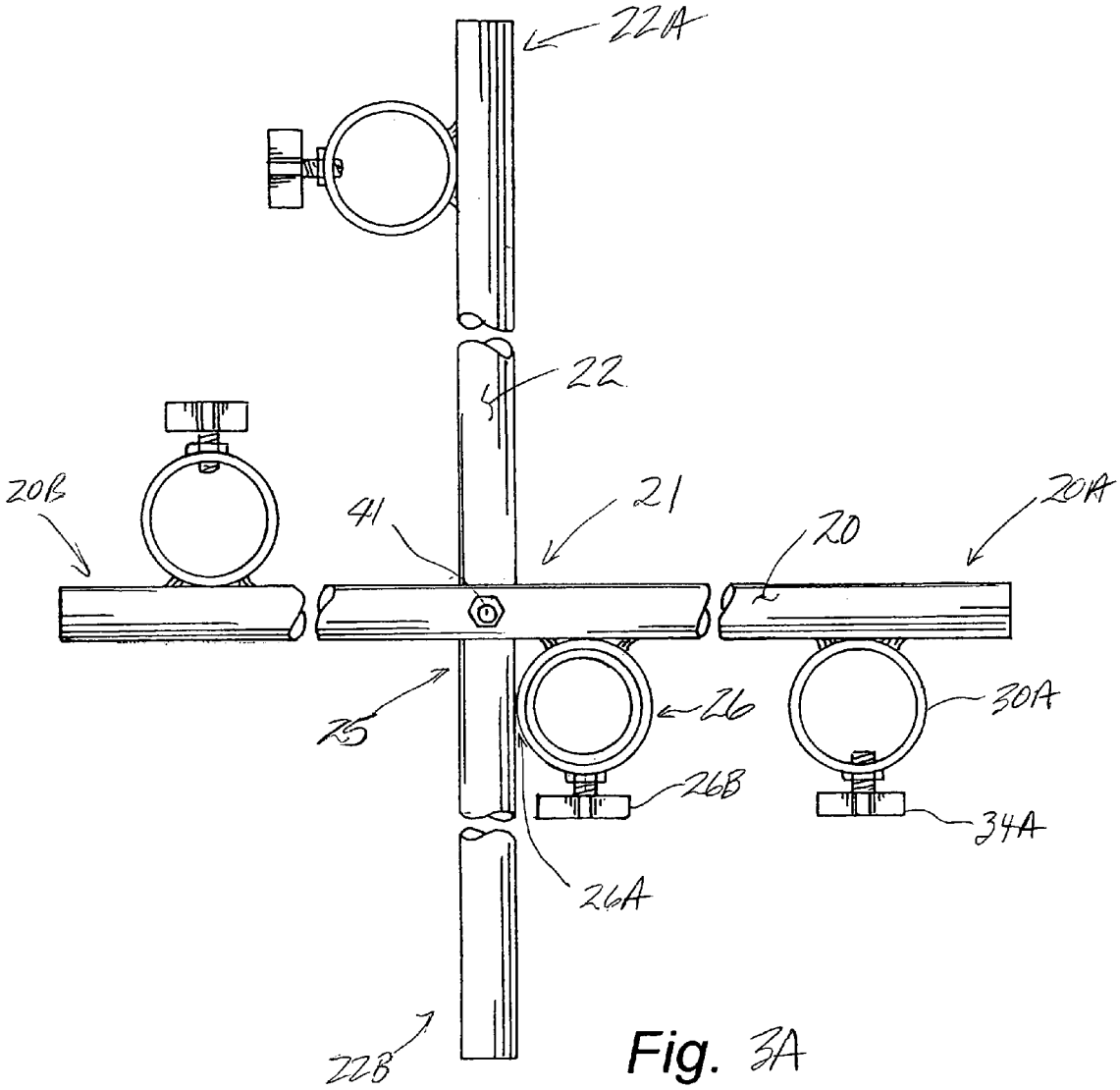
FIG. 3A is a top view of one possible embodiment of the invention, taken in the plane represented by the lines 3A-3A in FIG. 1, and showing first and second legs oriented substantially 90 degrees with respect to each other in a fully open operating configuration, with the first leg having first and second leveler feet and a stabilizer member attached thereto, and with the second leg having a third leveler foot attached thereto.

Referring again to both FIG. 1 and FIG. 2, the support stand 10 further includes a stabilizer member 26 which may be attached to the first or second leg 20, 22. However, FIG. 1 and FIG. 3A shows stabilizer member 26 preferably attached to first leg 20. Stabilizer member 26 is ideally selectively located along base leg 20 and may preferably be mounted so as to block movement of first leg 20 with respect to second leg 22 so as to stabilize the base 18 and support post 14 in the selected operating configuration. The first leg 20 and second leg 22 preferably form a plane to provide a base for support post 14. Stabilizer member may be positioned at selected blocking position as desired. For instance, stabilizer 26 may or may not be positioned to block movement at a ninety degree angle or at any angle between zero and ninety degrees, as desired. This configuration fosters additional stability when the support stand 10 is set up in an operating configuration. Support post 14 may then be substantially orthogonal to the plane of first leg 20 and second leg 22 when support post 14 is mounted to the stabilizer member 26.

In addition, it should be recognized that the stabilizer member 26 is mounted on the base 18 at a location that is relatively low to the ground. Stabilizer 26 may be welded, bolted, or otherwise secured to a leg of base 18. This configuration fosters a low center of gravity for the support stand 10 and further promotes stability.

As shown in FIG. 3A, the stabilizer member 26 is most preferably attached in a region around a midpoint 21 of the first leg 20 so as to block certain further rotation of the first leg 20 with respect to the second leg 22. In a preferred embodiment, the first leg 20 and second leg 22 are oriented at substantially 90 degrees (as denoted by Ao in FIG. 1) with respect to each other so as to splay the legs 20, 22 and set up the base 18 in a fully open operating configuration. In this configuration, the second leg 22 is adapted to be in positive contact with an outer surface 26A of the stabilizer member 26 to further foster stability. However, it should be appreciated that the first leg 20 and second leg 22 are selectively orientable with respect to each other at a range of angles between substantially 0 degrees and substantially 90 degrees—such that said base has a selectable footprint. Moreover, if desired an adjustment bolt may be provided between stabilizer 26 and one leg or between the legs of the base to control the range of the angle. In this way, the legs 20, 22 can be positioned around irregularities on the ground or on a road surface, surfaces recesses or potholes, obstacles, brushy vegetation, or rocks and the like (e.g., objects 74, 76 as shown in FIG. 9).

Figure 3B:
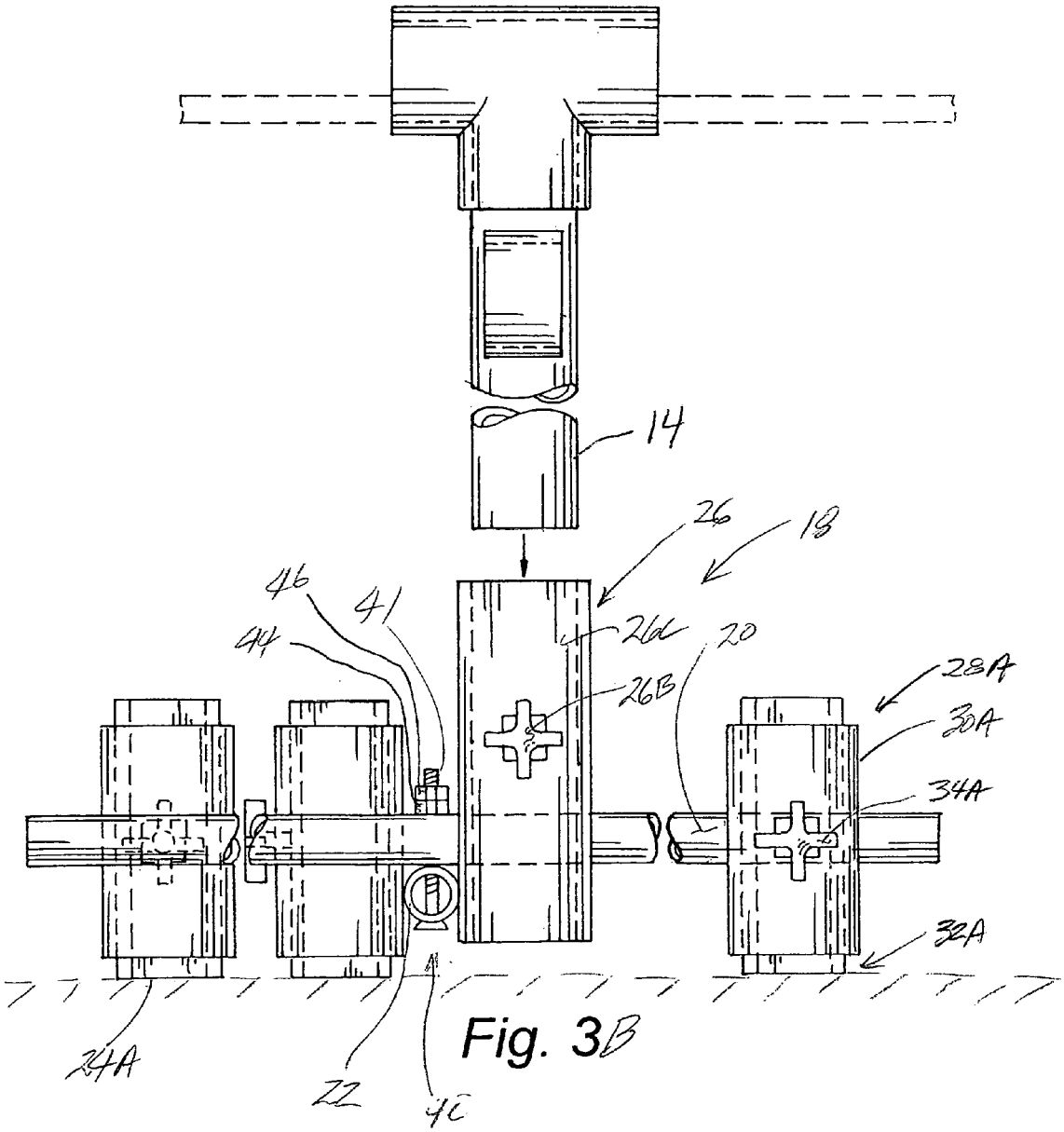
FIG. 3B is a front, elevational view of one possible embodiment of the invention showing the support stand in a set up configuration on a substantially flat surface with the support stand mounting a barrier line.

The stabilizer member 26 is preferably configured with a mating and connecting structure 26C and a locking member 26B for releaseably securing the support post 14 (see FIG. 1 and FIG. 3B). The support post may also be threadably connected or otherwise secured to the stabilizer member 26. The locking member 26B is adapted to frictionally engage the support post 14 to selectively fix it in a desired position. The functional end 16 of the support post 14 preferably comprises structure for securely attaching complementary structure of a platform member 27A particularly configured for mounting a barrier line 12A or the like. The platform member 27A in turn comprises structure for releaseably supporting a barrier structure 12A. As briefly mentioned before, the platform member may also have other configurations to support a variety of functional structures such as sign equipment 12C, video and camera equipment 12D, surveying equipment 12E and other mountable structures as shown in FIG. 9.

Figure 4:
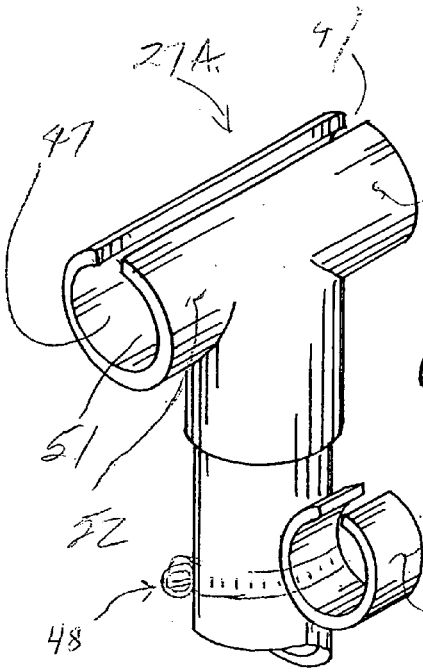
FIG. 4 is a fragmentary perspective view of one possible embodiment of the invention showing a platform member mounted to the support post, and showing an auxiliary securing structure mounted to the support post.

In a preferred embodiment, the platform member 27A comprises a tubular member 45 with a longitudinal bore 47 as shown in FIG. 4. The tubular member 45 defines a slot 49 longitudinally extending the length of the platform member 27A such that an interior 51 of the platform member 27A is in communication with an exterior 52 thereof to permit insertion of a barrier line structure 12A to cordon off an area.

Figure 10:
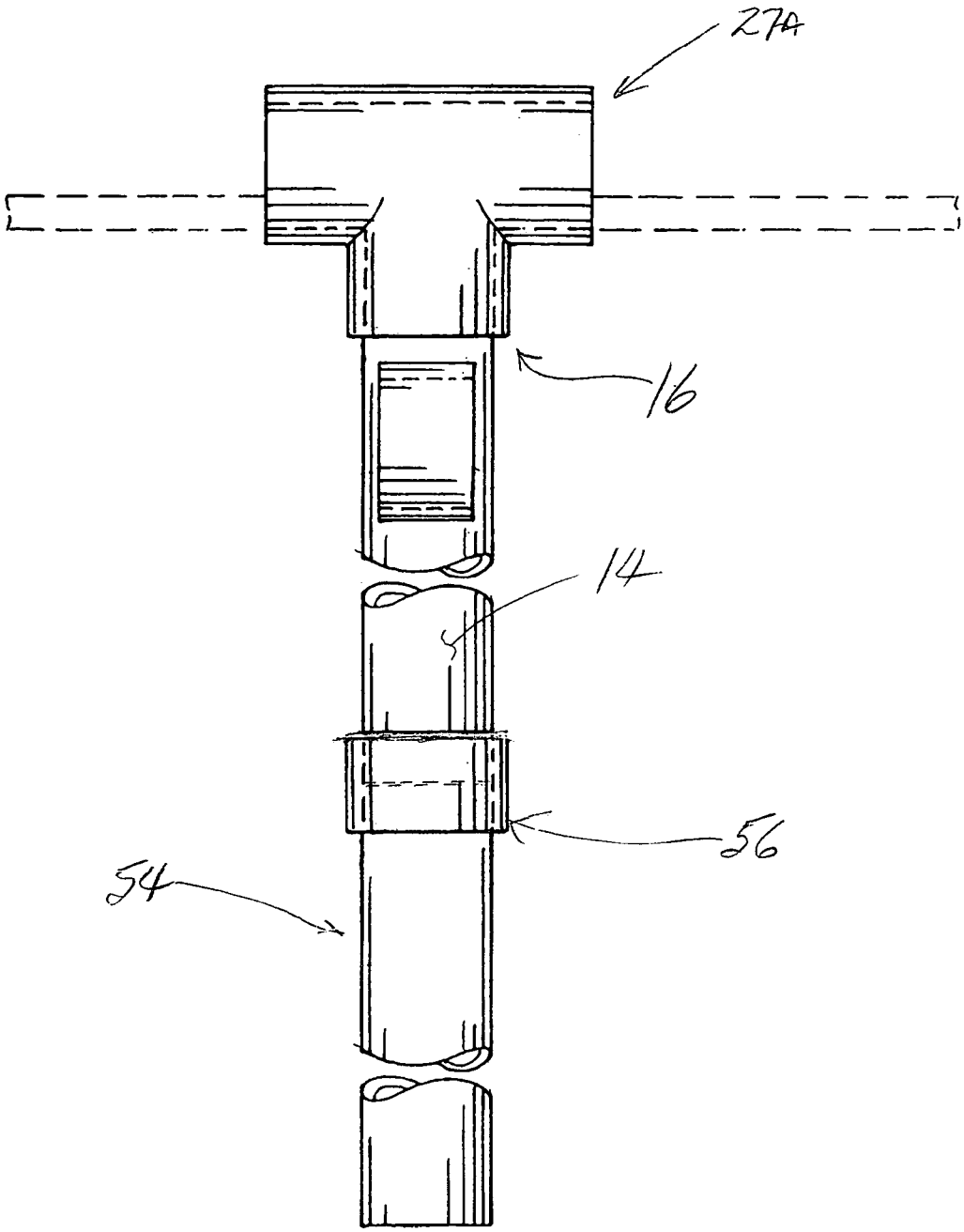
FIG. 10 is a fragmentary, front elevational view of a support post extension with coupling structure used to connect the support post or sign post.

The support stand assembly 10, in one possible preferred embodiment, also includes a support post extension 54, as shown in FIG. 10, comprising a coupling structure 56 to connect the support post extension 54 to the support post 14. Such a configuration permits the functional end 16 of support post 14 to be selectively positioned at any desired distance from the base 18 (not shown).

Referring again to FIG. 1, the support stand assembly 10 may preferably also include one or more auxiliary securing structures 19 selectively attachable at a selectable position to the support post 14. While securing structures 19 may be utilized for attaching different items as discussed hereinafter, one preferred use of structures 19 is to carry electrical cords as may desired, for instance, to keep the cords off wet ground. The auxiliary securing structure 19 may be secured adjacent the platform member 27A or at another location on the support post 14 by a clamp-like structure or other fasteners, such as fastener 48 (See also FIG. 4). The auxiliary securing structure 19 is adapted to support removable barrier equipment such as a secondary barrier line 19A or signal flag 12B as shown in FIG. 9 or other additional lines, flags, or the like. With such a configuration, the support stand assembly 10 may be used to form a fence-like structure to better cordon off a construction area or the like. Moreover, as shown in FIG. 9, to provide further protection around, for example, a highly restricted area, it should be appreciated that a third, short barrier line 19B may be attached between the auxiliary securing structure 19 or the platform member 27A downwardly (in one preferred embodiment) to an end of a base leg; then a fourth barrier line 19D may be mounted to barrier lines 19B of neighboring support stands 10 such that the fourth barrier line is selectively suspended lower than and in front of the first and second barrier lines 12A, 19A so as to help keep persons further away from a cordoned off or protected area.

Figure 6:
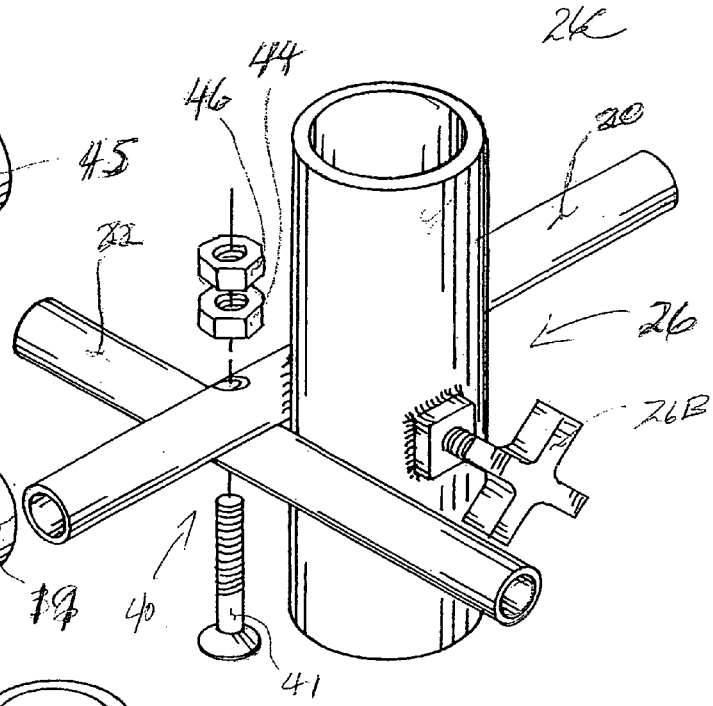
FIG. 6 is a fragmentary exploded perspective view of one possible embodiment of the invention showing a fastener pivotally connecting the first and second legs, and showing both legs oriented at substantially 90 degrees with respect to each other such that the second leg makes positive contact with the stabilizer member.
Figure 5:
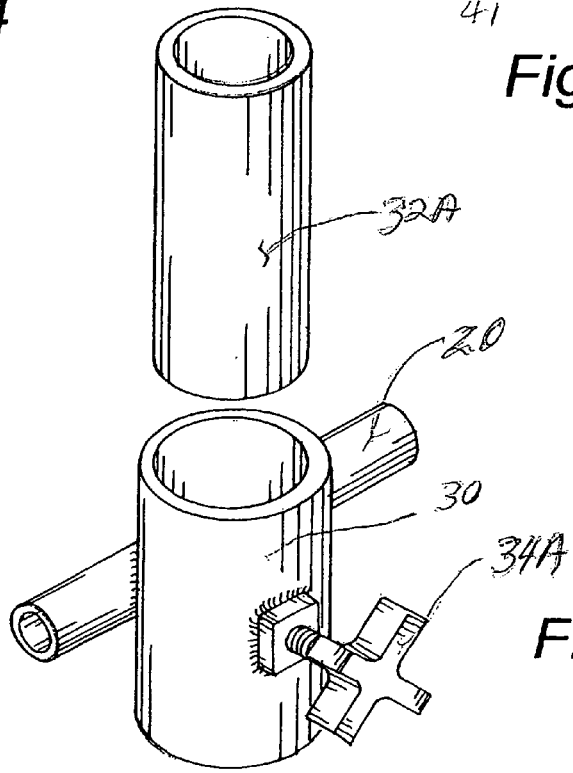
FIG. 5 is a fragmentary exploded perspective view of one possible embodiment of the invention showing a moveable structure of a leveler foot completely removed from a corresponding housing attached to the first leg.

Turning again to FIG. 1 and FIG. 6, the support stand assembly 10 may further comprise a fastener 40 to pivotally attach the legs 20, 22 with respect to each other. Fastener 40 is preferably configured to permit rotational movement of the first leg 20 with respect to the second leg 22 in a selected scissor-leg arrangement to foster stability of the support stand in the operating configuration. Although not the preferred embodiment, fastener 40 could conceivably be adapted for locking and/or unlocking the first leg 20 with respect to the second leg 22 to permit relative rotation of the first leg 20 with respect to the second leg 22 to a substantially parallel alignment in the closed stowed configuration (as shown in FIG. 2).

As shown in FIG. 3B, fastener 40 preferably comprises an engageable structure 41 such as a bolt or other fastener ideally attached to the second leg 22. The first leg 20 is pivotally mounted to the engageable structure 41 to permit relative rotation of the first and second legs 20, 22. The fastener 40 further comprises at least one engaging member 44 which has structure complementary (e.g., threadably or otherwise) to the engageable structure 41 for selective fastening or unfastening of the first leg 20 and the second leg 22 to prevent or permit relative rotation therebetween. When the legs 20 and 22 are in the operating position (90 degrees), preferably one nylon insert nut, such as nut 44, may be tightened to provide better stability. When the legs 20 and 22 are folded for storage, nut 44 must be loosened to allow the legs to be folded. Although not preferred, a double nut configuration of nut 44 and lock nut 46 may be utilized to provide a connection which is sufficiently loose to permit legs 20 and 22 to rotate with respect to each other but which remains tight. Other suitable connections might include a nylon insert nut, lock nut fluid to lock the nut in place, and/or any other arrangement which reliably performs these desired functions.

To further promote stability of the base 18, the engageable structure 41 may be fixedly (e.g., welded) attached to the second leg 22. This construction provides a more firm connection and facilitates assembly of the first and second legs 20, 22—without concern for losing or misplacing the engageable structure 41. As shown in FIG. 3B, the fastener 40 may further comprise at least two engaging members 44, 46 having structure complementary to said engageable member 41 to more positively lock the fastener 40 in a permanent connection which permits rotation of the legs with respect to each other. Various fasteners may be used for this purpose.

Figure 3C:
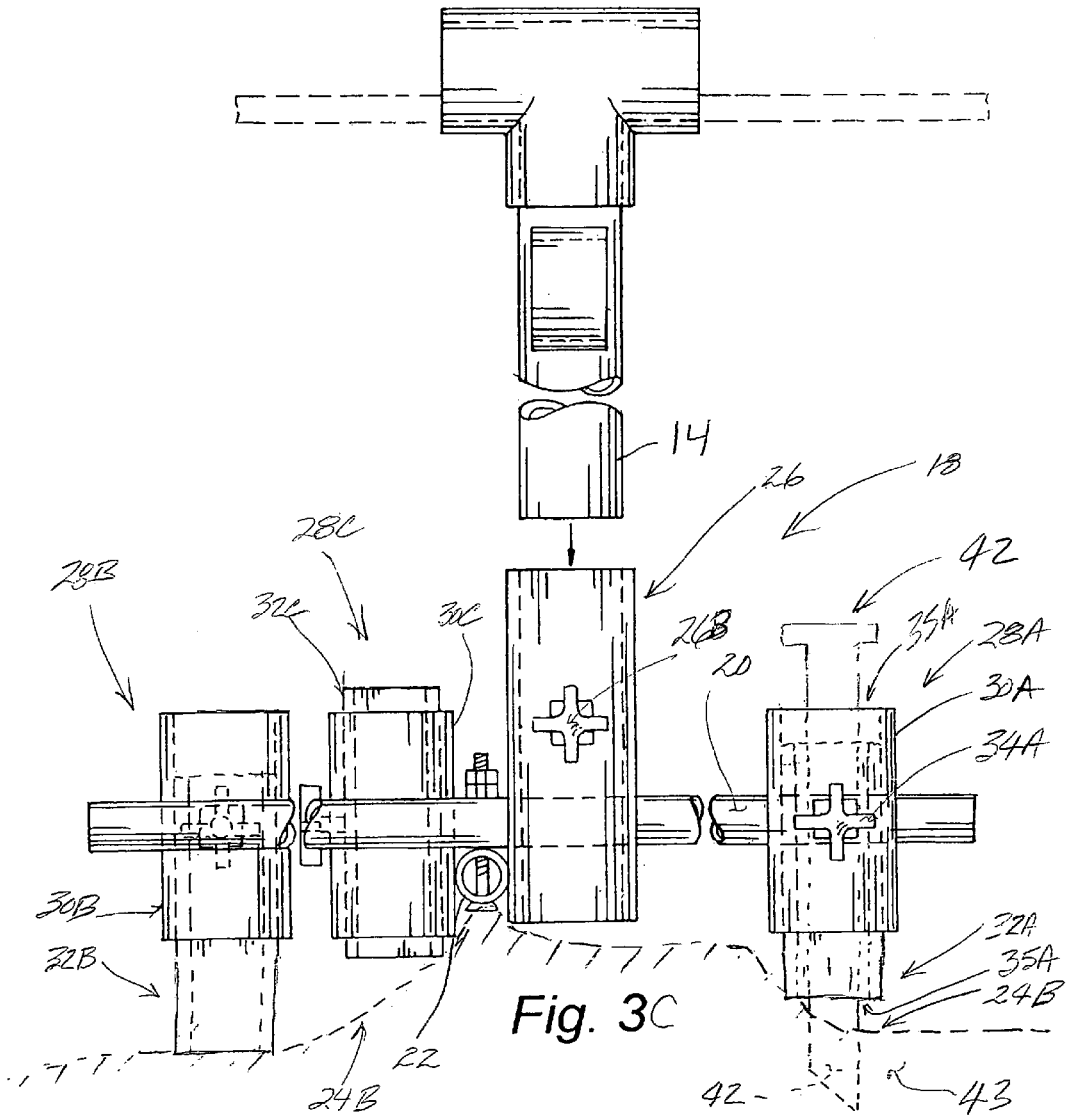
FIG. 3C is a front, elevational view of one possible embodiment of the invention showing the support stand in a set up configuration on a substantially contoured, irregular surface with the support stand mounting a barrier line.

Turning next to FIGS. 1, 3A, 3B, and 3C, the support stand 10 also preferably includes at least one leveler foot 28A which may be selectively attached to the first leg 20 or second leg 22 at a desired location such as any desired axial position. In a presently preferred embodiment as shown in FIG. 3B, the leveler foot 28A includes a housing 30A, moveable structure 32A, and a leveler locking member 34A. The moveable structure 32A is selectively extendable and retractable with respect to the housing 30A. Moveable structure 32A is typically extended to engage a generally flat surface 24A or irregularly contoured or sloped surface 24B (as shown in FIG. 3C) to permit substantially horizontal leveling of the support stand base 18 on such surfaces. The moveable structure 32A is alternatively retractable with respect to the housing 30A of leveler foot 28A.

Ideally, the support stand 10 may include a plurality of leveler feet, however at least three leveler feet 28A, 28B, and 28C are ideally employed with the support stand 10. As shown in FIG. 1, a first leveler foot 28A and a second leveler foot 28B are attached respectively adjacent opposing ends 20A, 20B respectively of the first leg 20; a third leveler foot 28C is preferably attached adjacent 22A end of second leg 22. However, the third leveler foot 28C could be attached adjacent either end 22A, 22B of the second leg 22. With such a configuration, the first, second, and third leveler feet 28A, 28B, 28C cooperate to level the support stand base 18 on an irregular, contoured, or flat surface as shown in FIGS. 3B and 3C. Moveable structure 32A is preferably releaseably secured within housing 30A in a telescoping relationship. Leveler locking member 34A includes structure configured to secure the moveable structure 32A with respect to housing 30A so as to fix movement of moveable structure 32A in a desired position with respect to housing 30A.

When the mounting surface is irregular, FIG. 3C, 22B must be positioned on the highest point so that the other three leveler feet may be adjusted properly to provide a plumb post 14. This requires judgment to determine the highest point for 22B. It has been determined that a fourth level foot 28D may be used so that it is not necessary to determine the highest irregular point.

As shown in FIG. 2, it should be recognized that with this unique multi-foot configuration, the base legs 20, 22 can be rotated to or oriented in the collapsed or closed stowed configuration with the legs 20, 22 substantially aligned such that the attached first, second, and third leveler feet 28A, 28B, 28C cooperate in conjunction with the stabilizer member 26 to securely capture the support post 14 adjacent the closed base 18.

In one possible preferred embodiment, the first and second legs are ideally tubular in configuration. Thus, inexpensive and readily available PVC pipe or other pipe may be utilized for construction of the present invention. The support post 14 is also ideally tubular and may formed from a somewhat flexible or resilient material, such as for example standard polyvinyl chloride. The support post 14 also preferably has an outside diameter, as denoted by Ds in FIG. 2, which is larger than an outside diameter, denoted by Dl, of said first and second legs 20, 22.

This configuration—as will be explained hereinafter—fosters tighter compactibility of the support post 14 adjacent the base in the closed stowed configuration. That is, as shown in FIG. 2, when the first and second legs 20, 22 are substantially aligned in a closed stowed configuration, the first, second, and third leveler feet 28A, 28B, 28C cooperate in conjunction with the stabilizer member 26 to flex the support post, and more securely capture the support post—in tension—adjacent the first and second legs 20, 22 and between the feet 28A, 28B, 28C.

The legs 20,22 are preferably substantially the same length. The length may vary depending on the application. Each leg 20, 22 may also be constructed in a telescoping configuration so that the length may be varied as needed for stability. However, in the preferred embodiment, the length of legs 20,22 is preferably substantially the same length as support post 14. This configuration further promotes compactibility of the support stand in the closed stowed configuration when the legs 20,22 and support post are positioned adjacent each other.

At least one securing member 36A such as a strap, latch, or the like, is preferably employed to positively affix the support post between the first, second, and third leveler feet and the stabilizer member with so as to flexibly capture the support post when the legs 20, 22 are in the collapsed or closed stowed configuration. In this way, the securing member 36A can be used to bind the collapsed stand for storage or shipping. Of course, a plurality of securing members 36A, 36B can also be employed for securing the support post in the stowed configuration.

In a presently preferred embodiment, at least one of the first or second legs 20, 22 preferably has an axial bore therethrough such that the securing member 36A can be stored within the bore 20C of first leg 20 or bore 22C of second leg 22. A plug 38 may preferably be employed to securely fit into bore 20C to contain securing member 36 therein. A plug 38 may be used at each end 20A, 20B, 22A, 22B, of the first and second legs 20, 22. However, ideally, only one plug will be needed, depending on the type of securing member 36A. That is, a fastener 40 (explained further hereinafter), which is preferably employed to pivotally mount the first and second legs-ideally (but not necessarily) near a midpoint thereof—serves to block and prevent the securing member 36A from passing all the way through the axial bore 20C of leg 20 and exiting the opposing open end 20A. For example, FIG. 2 shows plug 38 just prior to being installed in the open end 20B of the first leg 20. An example of a suitable plug 38 would be a vinyl pull-tab plug (e.g., McMaster-Carr Supply #9343 K56).

Referring again to FIGS. 1, 3A, and 3B, it should be appreciated that the preferred embodiment is constructed such that the first leg 20 and second leg 22 are interchangeable and the first, second and third leveler feet are interchangeable. This construction fosters simplicity of manufacture and ready replaceability in the event of the need to repair a leg 20, 22 or a leveler foot of said support stand 10. The first and second legs 20, 22 and at least a portion of said first, second and third leveler feet (e.g., the housings 30A-30C) are preferably formed from standard galvanized tubular material, which may also be useful for weighting purposes, but could also be formed from PVC or other suitable material.

The support post and the first, second and third moveable structures 32A-32C are preferably formed from standard plastic or resin tubular material so as to be readily available for replacement. As noted before, an example of a suitable material is polyvinyl chloride (PVC) or other suitable material. This material is resistant to various outdoor conditions and is lightweight so as to foster portability and ease of handling. Such a material also has insulating characteristics which—depending on the circumstances—may be favorable if using the support stand 10 to support certain types of electrical wiring.

In view of the above, the preferred simple construction and manufacture of the support stand assembly 10 is relatively inexpensive and typically comprises commonly available off-the-shelf materials. Such a configuration further enhances the long-term prospect of being able to readily repair the support stand 10 should a component become damaged and need to be repaired or replaced.

Referring again to FIG. 3C, in a preferred embodiment, the leveler feet 28A-28C include movable structures 32A, 32B, 32C, respectively, each having an axial bore therethrough. For example, moveable structure 32A has axially extending bore 35A adapted to receive an anchoring stake 42 or the like which may be driven axially through said moveable structure 32A and into the ground 43 so as to more firmly anchor the support stand base 18 to the ground 43. As another example, rather than stake 42, a long steel or PVC pipe may be utilized. After post 14 is plumb, stakes or pipes may be pounded into the ground to provide a sturdy support even with very heavy wind resistance. Such a configuration would help prevent the support stand from being inadvertently turned over when mounting, for example, a barrier line, a sign, or expensive camera equipment or the like, as shown in FIG. 9. Maintaining stability of the support stand 10 would be critical if used to support a warning sign or barrier line near traffic or in an area with pedestrians passing nearby. With an anchoring stake in place, the support stand 10 would less likely be inadvertently blown over into oncoming traffic or knocked over on passing pedestrians. This feature also can help keep a barrier or sign oriented properly when used to block-off, barricade, or warn drivers or pedestrians of dangerous areas around highway or building construction sites.

One possible procedure to plumb post 14 might be to utilize a post level such as provided from Mc Master-Carr, Catalog #109, page 2083, item number 2186A12. Other post levels may be obtained from stores such as Home Depot. The post level may be fastened to the top of post 14. The ground is then surveyed and leg 22B (as shown in FIG. 1) is positioned on the highest part of the ground. As best shown in FIG. 3C, then elements 32A, 32B, and 32C are axially adjusted until the vials of the post level show that post 14 is plumb and then locked in position.

If 32A-32C are long pipes that must be driven in the ground, then legs 20 and 22 can be initially supported by blocks while 32A-32C are pounded into the ground whereupon the blocks and post level can be removed.

In one preferred embodiment housings 30A, 30B, and 30C (shown in FIG. 3C) and axially adjustment members 32A, 32B, and 32C may utilize a relatively close tolerance. For example in one embodiment, one inch tubular members 32A, 32B, and 32C may be utilized which have an outer diameter of 1.315 inches (1" standard pipe). Housings 30A, 30B, and 30C may comprise 1-¼" standard pipes, standard wall, with 1.380 inside diameters thereby providing a clearance of 0.065 inches or approximately one-sixteenth inch.

Figure 7B:
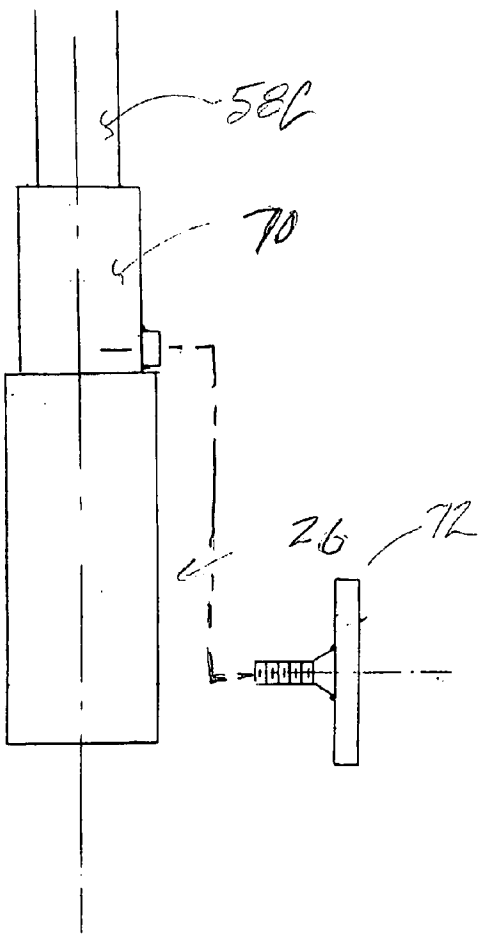
FIG. 7B is a fragmentary front elevational view of one possible embodiment of the invention showing a sign post releaseably secured by an adapter sleeve mounted to the stabilizer member.
Figure 7A:
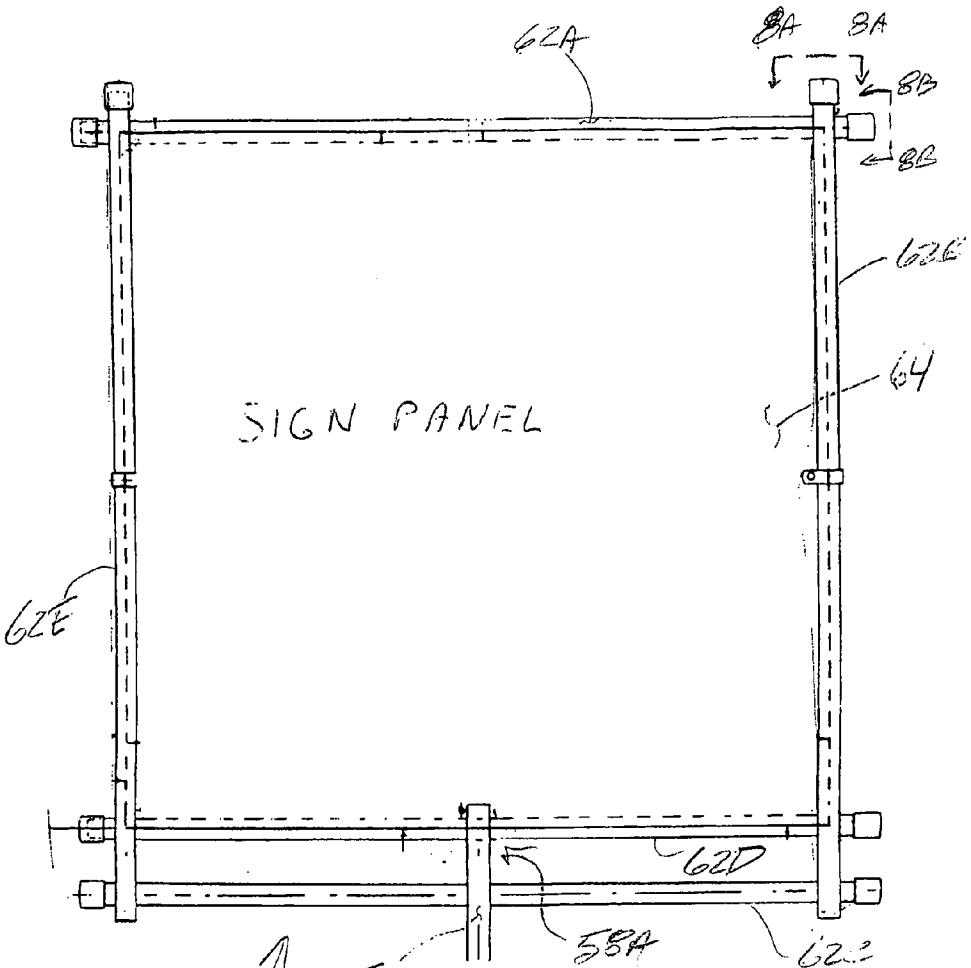
FIG. 7A is a fragmentary front elevational view of one possible embodiment of the invention showing a sign post mounting a sign frame, and showing a display sign panel mounted to the sign frame (but not showing structural member connections used to releaseably connect sign frame members)

Turning now to FIG. 1, FIG. 7A and FIG. 9, a possible preferred embodiment of the support stand assembly is shown including a sign post 58. The sign post 58 has a functional end 58A. The stabilizer member 26 (shown in FIG. 1) may be used to mount the sign post 58 employing the same configuration as that used to mount the support post 14. With such a configuration, the sign post would have an outside diameter which is substantially the same as that of the support post 14 (denoted by Ds in FIG. 2). Thus, the stabilizer member 26 would preferably be configured with a mating and connecting structure 26C a locking member 26B for releaseably and/or telescoping securing the sign post 58 in a substantially upright orientation. The sign post 58 may also be threadably connected or otherwise secured to the stabilizer member 26. The functional end 58A of the sign post 58 is configured to mount a sign frame 60 (see FIG. 7A and FIG. 9). Suitable mounting structures such as brackets or clamps may be used to secure the sign frame 60 to the sign post 58.

The sign frame 60 is preferably comprised of at least a plurality of frame members. One possible preferred embodiment comprises five frame members 62A-62E. The frame members 62A-62E are releaseably connectable with respect to each other to form an adjustable sized frame which may be selectively expanded or contracted to fit a desired sign display panel 64. In one preferred embodiment, sign panel 64 is squeezed between adjustably positioned frame members 62A, 62B, 62D, and 62E.

Figure 8A:
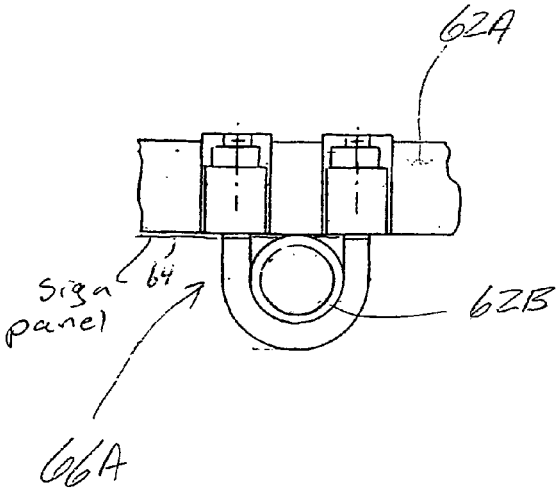
FIG. 8A is a fragmentary top view of one possible embodiment of the invention taken in the plane represented by the line 8A-8A in FIG. 7A, but showing a structural member connection (omitted in FIG. 7A) used to releaseably secure one frame member to another frame member in a substantially orthogonal relationship with respect to each other.
Figure 8B:
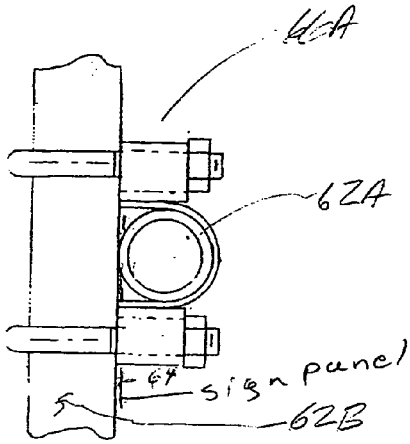
FIG. 8B is a fragmentary side view of one possible embodiment of the invention taken in the plane represented by the line 8B-8B in FIG. 7A, but showing the structural member connection (omitted in FIG. 7A) used to releaseably secure one frame member to another frame member in a substantially orthogonal relationship with respect to each other.

The frame members 62A-62E are preferably connected with adjustable structural member connectors 66A-66F, as shown in FIGS. 8A and 8B (but not shown in FIG. 7A), for quickly securing and unsecuring frame member connections. FIG. 8A illustrates a top view and FIG. 8B illustrates a side view of one connector 66A used to connect frame member 62A to 62B (shown in FIG. 7A). With such a configuration, the frame members 62A-62E are in substantially orthogonal relationship with respect to each other. Suitable mounting structures such as brackets or clamps may be used to secure the display sign to the frame 60. Moreover the size of the rectangle or square can be adjusted to any size using the clamps as desired as shown in FIG. 8A and FIG. 8B or other clamps as shown in my previous patent referenced hereinbefore. Thus, may different sign sizes may be used by adjusting the clamps.

In another preferred embodiment, as shown in FIG. 9, the sign frame 60A comprises one frame member 68 being releaseably attached to a long sign post 58B at a region around a midpoint 69 of the frame member 68. The sign frame 60A comprises a structural member connector (similar to connector 66A shown in FIG. 8A and FIG. 8B) for releasable attachment. Suitable mounting structures such as brackets or clamps may be used to secure the display sign to the frame 60A.

In another possible preferred embodiment, the sign post (having the same outside diameter as the support post 14) may also be used with an extension 54 as shown in FIG. 10 to selectively position the functional end 58A of the sign post (in the same way as support post functional end 16) at a desired distance from the base 18 (not shown). Such a configuration would foster interchangeability when the extension 54 is used with either the support post 14 or sign post 58.

It will be appreciated that the sign post 58 and frame members 62A-62E (after being disassembled) are also preferably securable adjacent the base in a closed stowed configuration. That is, when the base legs 20, 22 are rotated and oriented the closed stowed configuration with the first and second legs 20, 22 substantially aligned, the attached first, second, and third leveler feet 28A-28C cooperate in conjunction with the stabilizer member 26 to securely capture the stowed sign post 58 and disassembled frame members 62A-62E adjacent said closed base.

It should be recognized that the sign post may preferably have an outside diameter that is smaller or larger than the support post 14. For example, in a possible preferred embodiment as shown in FIG. 7B, the sign post 58C may be formed from a more sturdy galvanized or metal material and have a smaller outside diameter than the support post 14 (not shown). With such a configuration, an adapter sleeve 70 is preferably adapted to be alternately attached to the stabilizer member 26 in the same way that the support post 14 would be mounted thereto. The adapter sleeve 70 comprises a securing fastener 72 for releaseably mounting the signpost 58. The adapter sleeve 70 has similar mating and connecting structure to that of stabilizer member 26 in order to releaseably secure the sign post 58 in a substantially upright orientation.

The present invention can be utilized in many ways. For instance, in another conceivable alternate embodiment, the legs 20, 22 might be pivotally attached at their respective ends to form a base 18A as shown in FIG. 9 for supporting lines at the corners as indicated. It may be desirable to have a swinging sign to reduce the wind load. A moving sign may attract more attention. However, if legs 20, 22 are of a suitable standard length, and/or support spikes or pipes or utilized as discussed hereinbefore, this should not be necessary. However, if used in this way, the stand 10A could readily be used to support a barrier structure 12A forming a corner of a bounded area wherein long and/or heavy barrier cables, electrical cables, and the like, 12A might be utilized. The legs may also be pivotally connected at some other intermediate location between the midpoint of the legs and their ends to form a different base configuration 18B of stand 10B as shown in FIG. 9. The stabilizer member 26 (as shown in FIG. 1) could also be fixedly attached along the outer surface of either leg 20, 22 and adjacent the pivot connection as desired to enhance stability.

In operation of one possible embodiment, a barrier may be readily set up and collapsed using the support stand assembly 10. The pivotally connected first and second legs 20, 22 are preferably rotated with respect to each other so as to orient the second leg 20 in a range of angles substantially around 90 degrees with respect to said first leg 22, such that the second leg 20 positively contacts the outer surface 26A of the stabilizer member 26 to foster stability of the base 18 in the set up operating configuration. The support post 14 is then mounted to the stabilizer member 26 and fixedly secured in place by tightening the stabilizer locking member 26B.

Barrier equipment such as, for example, a barrier line 12A and signal flag 12B, may then be mounted to the support post using an appropriately selected platform member 27A (as shown in FIG. 1 and FIG. 9). Other equipment such as, for example, camera/video equipment or surveying equipment may also be mounted as desired when using an appropriate platform member (e.g., 27D, 27E).

After use, the support stand assembly 10 may be broken down and collapsed into the closed stowed configuration for storage or shipping as shown in FIG. 2. For example, barrier equipment 12A, 12B would first be detached from the support post 14. Then the support post 14 is detached from the stabilizer member 26 by untightening the locking member 26B. Both legs 20,22 are rotated and oriented such that the legs are substantially aligned in a stowed configuration. The support post 14 is then stowed in a substantially parallel configuration adjacent the first and second legs 20, 22. Support post 14 may be slightly bent around stabilizer member 26 to provide a more rigid stowed configuration and so support post may be comprised of a somewhat flexible material such as PVC pipe. Securing members 36A and 36B (such as a plastic ties or straps) are then tied around the support post 14 and the first and second legs 20, 22 in a compactable bundle for shipping and handling. A similar operation may be used to breakdown and stow the sign post 58 and frame members 62A-62E.

Many variations of the above assembly may be utilized. One or more moveable structures 32A-32C could be made substantially longer than their respective housings 30A-30C. For example, moveable structure 32A could be made several feet long for leveling and use on steeply sloped roofs. Please refer to the earlier discussion hereinbefore for leveling post 14 which could essentially also be used for this situation. Also, the support post 14 could be telescoping in both directions such that it can support functional structures at varying heights. In addition, the support post could be extended through the stabilizer member 26 in such a way as to engage the surface below the stand 10 so as to help in leveling the stand or provide an additional leveler foot to foster stability.

The foregoing disclosure and description of the invention is illustrative and explanatory of presently preferred embodiments of the invention and variations thereof, and it will be appreciated by those skilled in the art, that various changes in the design, organization, order of operation, means of operation, equipment structures and location, methodology, the use of mechanical equivalents, such as different types of fasteners than as illustrated whereby different steps may be utilized, as well as in the details of the illustrated construction or combinations of features of the various elements may be made without departing from the spirit of the invention. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size and arrangement of the components may be varied from that shown and the invention still operate well within the spirit of the invention as described hereinbefore and in the appended claims. Thus, various changes and alternatives may be used that are contained within the spirit of the invention.

Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative of a presently preferred embodiment and not in a limiting sense.

What is claimed is:

1. A support stand assembly comprising:

a support post having a functional end adapted for leveling on a functional structure;

a base comprising a first leg and a second leg pivotally connected with respect to each other, said first leg and said second leg being rotatable to an angle with respect to each other in an operating configuration, and said legs being alternately rotatable such that said first and said second legs are substantially aligned in a stowed configuration for storage and shipping; and at least one of stabilizer members attachable to first and second legs, said one of stabilizer members; a connector for releaseably securing said support post in a substantially upright orientation;

an adapter sleeve configured to be alternately attached to said one of stabilizer members said adapter sleeve comprising structure adapted to mount a sign post; and a sign post having a functional end, said adapter sleeve being mounted to said stabilizer member, said adapter sleeve comprising mating and connecting structure to releaseably secure said sign post in a substantially upright orientation, said functional end of said sign post being adapted to mount a sign frame.

* * * * *

UNITED STATES PATENT AND TRADEMARK OFFICE

CERTIFICATE OF CORRECTION

PATENT NO. : 7,273,198 B2
APPLICATION NO. : 10/983492
DATED : September 25, 2007
INVENTOR(S) : Mills C. Tourtellotte and Frank Alderete It is certified that error appears in the above-identified patent and that said Letters Patent is hereby corrected as shown below:

Column 14, Claim 1, line 54, insert --at least-- between “said” and “one”.

Column 14, Claim 1, line 54, delete “;” after “members” and insert --comprising-- between “members” and “a”.

Column 14, Claim 1, line 58, insert --,-- between “members” and “said”.

Signed and Sealed this

Eighteenth Day of December, 2007

JON W. DUDAS
*Director of the United States Patent and Trademark Office*